US009061213B2

(12) United States Patent
Hsu et al.

(10) Patent No.: US 9,061,213 B2
(45) Date of Patent: Jun. 23, 2015

(54) SWING SET

(75) Inventors: Yaw Yuan Hsu, Xiamen (CN); Husi Sheng Chang, Xiamen (CN); Dean Randall Eyerly, Toledo, OH (US)

(73) Assignee: Intex Recreation Corp., Long Beach, CA (US)

( * ) Notice: Subject to any disclaimer, the term of this patent is extended or adjusted under 35 U.S.C. 154(b) by 392 days.

(21) Appl. No.: 13/702,512

(22) PCT Filed: Apr. 11, 2011

(86) PCT No.: PCT/US2011/031929
§ 371 (c)(1), (2), (4) Date: Sep. 6, 2013

(87) PCT Pub. No.: WO2011/127464
PCT Pub. Date: Oct. 13, 2011

(65) Prior Publication Data

US 2013/0337925 A1 Dec. 19, 2013

(30) Foreign Application Priority Data

| | | |
|---|---|---|
| Apr. 9, 2010 | (CN) | 2010 2 0161356 |
| Apr. 9, 2010 | (CN) | 2010 2 0161359 |
| Apr. 9, 2010 | (CN) | 2010 2 0161362 |
| Aug. 16, 2010 | (CN) | 2010 2 0298258 |

(51) Int. Cl.

| | |
|---|---|
| ***A63G 9/00*** | (2006.01) |
| *A47D 13/00* | (2006.01) |
| *A63G 31/00* | (2006.01) |

(52) U.S. Cl.
CPC .. *A63G 9/00* (2013.01); *A63G 31/00* (2013.01)

(58) Field of Classification Search
CPC ..... A63G 9/00; A63G 9/02; A63G 9/12; A47D 13/105; A47D 13/107
USPC ..... 472/118–125; 297/273, 274
See application file for complete search history.

(56) References Cited

U.S. PATENT DOCUMENTS

| | | | | | |
|---|---|---|---|---|---|
| 684,451 | A * | 10/1901 | Mowry | 403/87 |
| 3,500,868 | A * | 3/1970 | Hardt et al. | 138/127 |
| 3,990,667 | A * | 11/1976 | Tomalinas, Jr. | 248/370 |
| 5,505,664 | A * | 4/1996 | Nolan et al. | 472/120 |
| 2010/0048311 | A1* | 2/2010 | Spencer et al. | 472/118 |

* cited by examiner

*Primary Examiner* — Kien Nguyen
(74) *Attorney, Agent, or Firm* — Faegre Baker Daniels LLP

(57) ABSTRACT

A swing set (10) is shown including a support beam (16), a plurality of legs (14), and swing apparatus (18, 24, 26) supported by the support beam. The support beam and legs include a plurality of tubes (28, 30, 38, 40, 44) coupled together by connectors (42, 48). The connectors include an inner tube (66) and a cover (68, 68') positioned over the inner tube. Feet (46) are provided at the lower ends of the legs that rotate relative to the legs.

21 Claims, 20 Drawing Sheets

SWING SET

CROSS-REFERENCE TO RELATED APPLICATIONS

This application is a nationalization of PCT Application Serial No. PCT/US2011/031929, which claims priority to Chinese Patent Application No. 201020161359.4, filed Apr. 9, 2010; Chinese Patent Application No. 201020161362.6, filed Apr. 9, 2010; and Chinese Patent Application No. 201020161356.0, filed Apr. 9, 2010, the entire disclosures of which are expressly incorporated by reference herein.

FIELD OF THE INVENTION

The present invention relates to swing sets for outdoor use, in particular to frames for swing sets.

BACKGROUND AND SUMMARY OF THE INVENTION

Swing sets are mostly used by children for recreation and entertainment. A simplified swing is constructed by supporting a swing seat by a rope around a tree branch or other objects which can provide some support.

Assembly swing sets include various prefabricated bar members that are welded together, which limits the positions of the prefabricated bar members. Further, the length of each prefabricated bar member is fixed, which is inconvenient for the transportation thereof. Moreover, the swing set is difficult, if not impossible, to disassemble once built and the ability to expand the functions thereof is limited. Accordingly, the device of the present disclosure described herein addresses these disadvantages, providing for an improved swing set.

According to the present invention, a swing set is provided including a support beam and at least one swing apparatus configured to support a child thereon for recreation. The swing apparatus is supported by the support beam to permit swinging movement. The swing set further includes a plurality of legs supporting the support beam. At least one of the support beam and the plurality of legs includes at least two support tubes and a connector coupling the two support tubes together. The connector includes a metallic tube and a rigid, plastic cover. The metallic tube has a unique exterior surface and the rigid, plastic cover has an interior surface customized to match the unique exterior surface of the metallic tube.

According to another aspect of the present invention, a method of providing a swing set is provided including the steps of providing a plurality of support beam components to be assembled into a support beam of a swing set and providing at least one swing apparatus configured to support a child thereon for recreation. The support beam is configured to support the swing apparatus to permit swinging movement. The method further includes the step of providing a plurality of legs configured to support the support beam. At least one of the support beam and the plurality of legs includes at least two support tubes and a connector coupling the two support tubes together. The connector includes a metallic tube having a unique exterior surface. The method further includes the step of customizing a rigid, plastic cover to have an interior surface customized to match the unique exterior surface of the metallic tube.

According to another aspect of the present invention, a swing set is provided including a support beam and at least one swing apparatus configured to support a child thereon for recreation. The swing apparatus is supported by the support beam to permit swinging movement. The swing set further includes a plurality of legs supporting the support beam. At least one of the support beam and the plurality of legs includes a metallic tube having a first end and an opposite second end, at least one metallic extension coupled to the metallic tube between the first and second ends, and a rigid, plastic cover, positioned over the metallic tube and the extension.

According to another aspect of the present invention, a swing set is provided including a support beam and at least one swing apparatus configured to support a child thereon for recreation. The swing apparatus is supported by the support beam to permit swinging movement. The swing set further includes a plurality of legs supporting the support beam. At least one of the support beam and the plurality of legs includes at least two support tubes and a connector coupling the two support tubes together. The connector includes a inner tube and a plastic cover positioned between at least a first of the support tubes and the inner tube.

According to another aspect of the present invention, a swing set is provided including a support beam and at least one swing apparatus configured to support a child thereon for recreation. The swing apparatus is supported by the support beam to permit swinging movement. The swing set further includes a plurality of legs supporting the support beam. At least one of the support beam and the plurality of legs includes at least two support tubes and a connector coupling the two support tubes together. The connector has an octagonal exterior profile.

According to another aspect of the present invention, a swing set is provided including a support beam and at least one swing apparatus configured to support a child thereon for recreation. The swing apparatus is supported by the support beam to permit swinging movement. The swing set further includes a plurality of legs supporting the support beam. At least one of the support beam and the plurality of legs includes at least two support tubes and a connector coupling the two support tubes together. The connector has a first portion positioned within a first of the two support tubes and a second portion positioned within a second of the support tubes.

According to another aspect of the present invention, a swing set is provided including a support beam and at least one swing apparatus configured to support a child thereon for recreation. The swing apparatus is supported by the support beam to permit swinging movement. The swing set further includes a plurality of leg units supporting the support beam. Each leg unit includes at least two legs. Each leg includes two support tubes of substantially equal length and a connector coupling the two support tubes together.

According to another aspect of the present invention, a swing set is provided including a support beam and at least one swing apparatus configured to support a child thereon for recreation. The swing apparatus is supported by the support beam to permit swinging movement and includes at least one support tube suspended from the support beam and a seat supported by the support tube. The support tube includes first and second co-linear tubes coupled together to support the seat. The swing set further includes a plurality of legs supporting the support beam.

According to another aspect of the present invention, a swing set is provided including a support beam including a plurality of support tubes each having a length and at least one swing apparatus configured to support a child thereon for recreation. The swing apparatus is supported by the support beam to permit swinging movement. The swing set further includes a plurality of legs supporting the support beam. Each of the legs includes a plurality of support tubes each having a length. The swing accessory has a lowermost portion vertically spaced apart from the support beam by a distance that is greater than the lengths of the support tubes of the support beam and greater than the lengths of the support tubes of the plurality of legs.

According to another aspect of the present invention, a swing set is provided including a support beam and at least one swing apparatus configured to support a child thereon for recreation. The swing apparatus is supported by the support beam to permit swinging movement. The swing set further includes a plurality of legs supporting the support beam. Each leg includes at least one tube and a foot coupled to the tube to support the tube on the ground. The foot includes a base, a socket, and a ball positioned in the socket to permit pivoting of the base relative to the tube.

Figure 1:
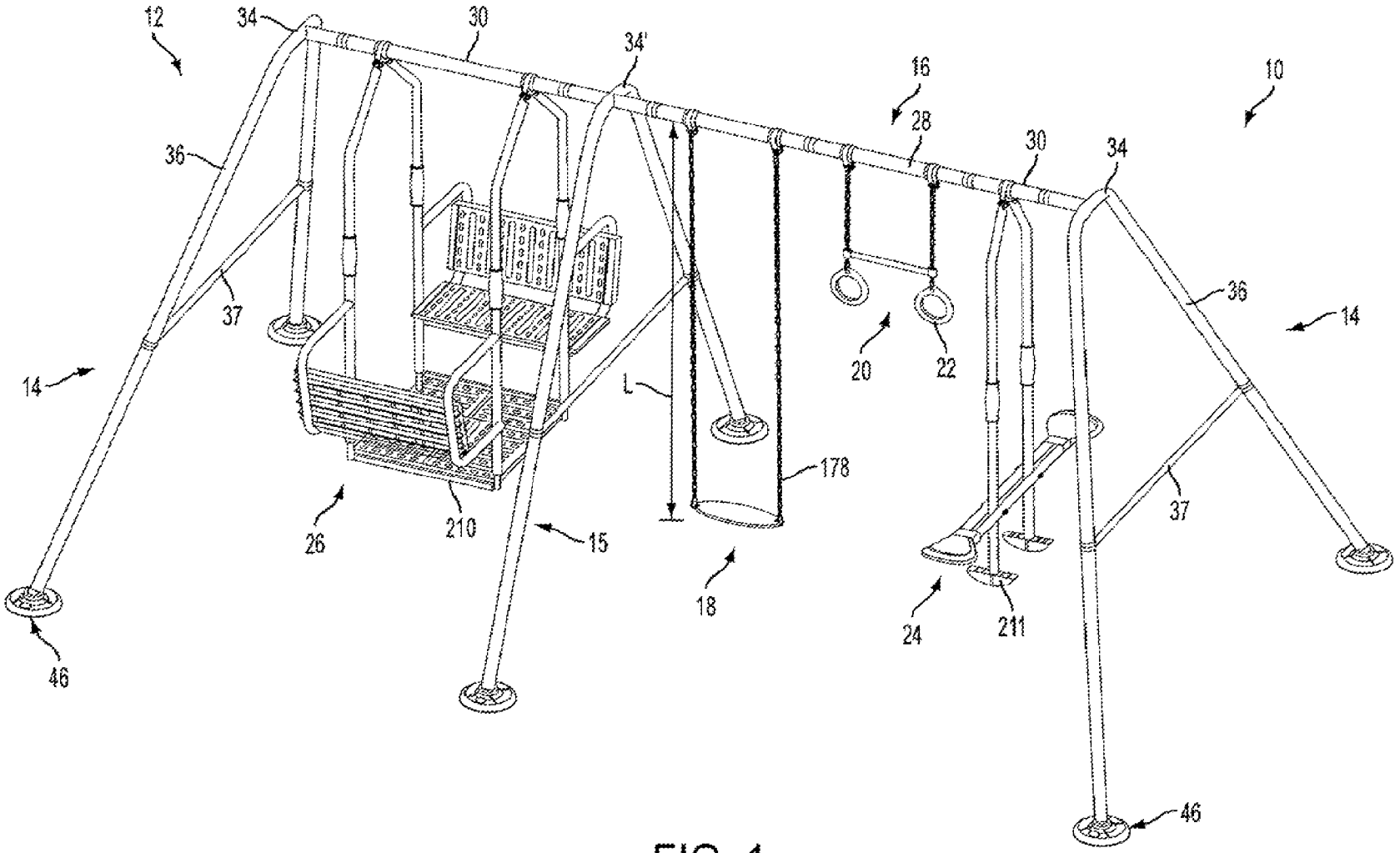
FIG. 1 is a perspective view of a first swing set of the present disclosure showing the swing set including a bench glider, a swing seat, a trapeze bar with rings, and a tandem glider.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF THE PREFERRED EMBODIMENTS

The embodiments disclosed below are not intended to be exhaustive or limit the invention to the precise forms disclosed in the following detailed description. Rather, the embodiments are chosen and described so that others skilled in the art may utilize their teachings.

As shown in FIGS. 1-11, swing sets 10 are shown for use by children for recreation. Swing sets 10 includes a frame 12 having two end leg units 14, one or more middle leg units 15, and top support beam 16 supporting one or more swing set apparatus, such as swing seat 18, trapeze bar 20 with rings 22, tandem glider 24, and dual bench glider 26. The swing sets described herein are modular so that additional swing set apparatus can be added to a base swing set to increase the size and features of the swing set.

Swing set 10*a* shown in FIG. 1 includes a pair of end leg units 14, a single middle leg unit 15, a top support beam 16, a dual bench glider 26 positioned between one end leg unit 14 and middle leg unit 15, and a swing seat 18, trapeze bar 20 with rings 22, and tandem glider 24 positioned between the other end leg unit 14 and middle leg unit 15. Top support beam 16 includes one or more apparatus support tubes, such as single pivot support tubes 28 and dual pivot support tubes 30. Single pivot tubes 28 support swing set apparatus, such as swing seat 18 and trapeze bar 20, that pivot about a single axis of rotation. Whereas dual support tubes 30 support apparatus, such as dual bench glider 26 and tandem glider 24, that pivot about two axes of rotation. As discussed in greater detail below, connectors 42 are provided between respective support tubes 28, 30 and end leg units 14.

Figure 3:
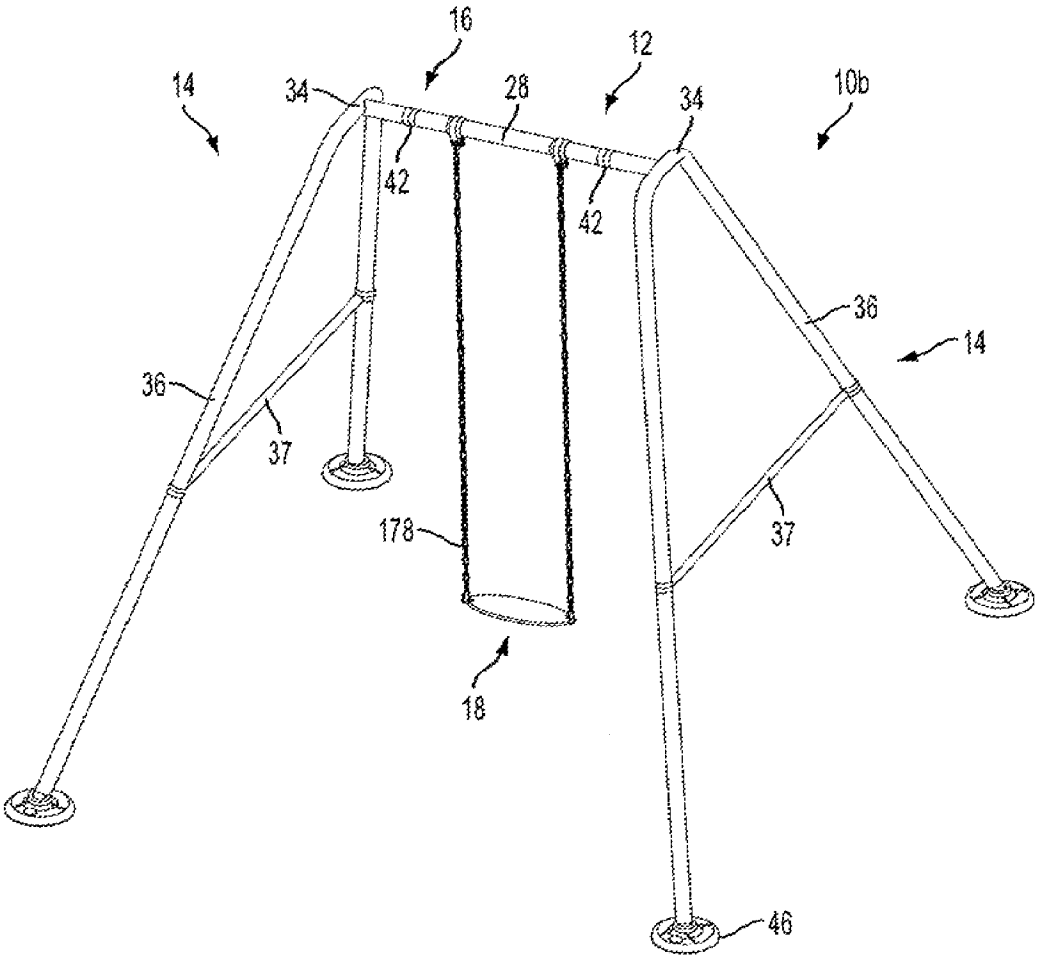
FIG. 3 is a perspective view of a second swing set of the present disclosure showing the swing set of including a single swing seat.
Figure 4:
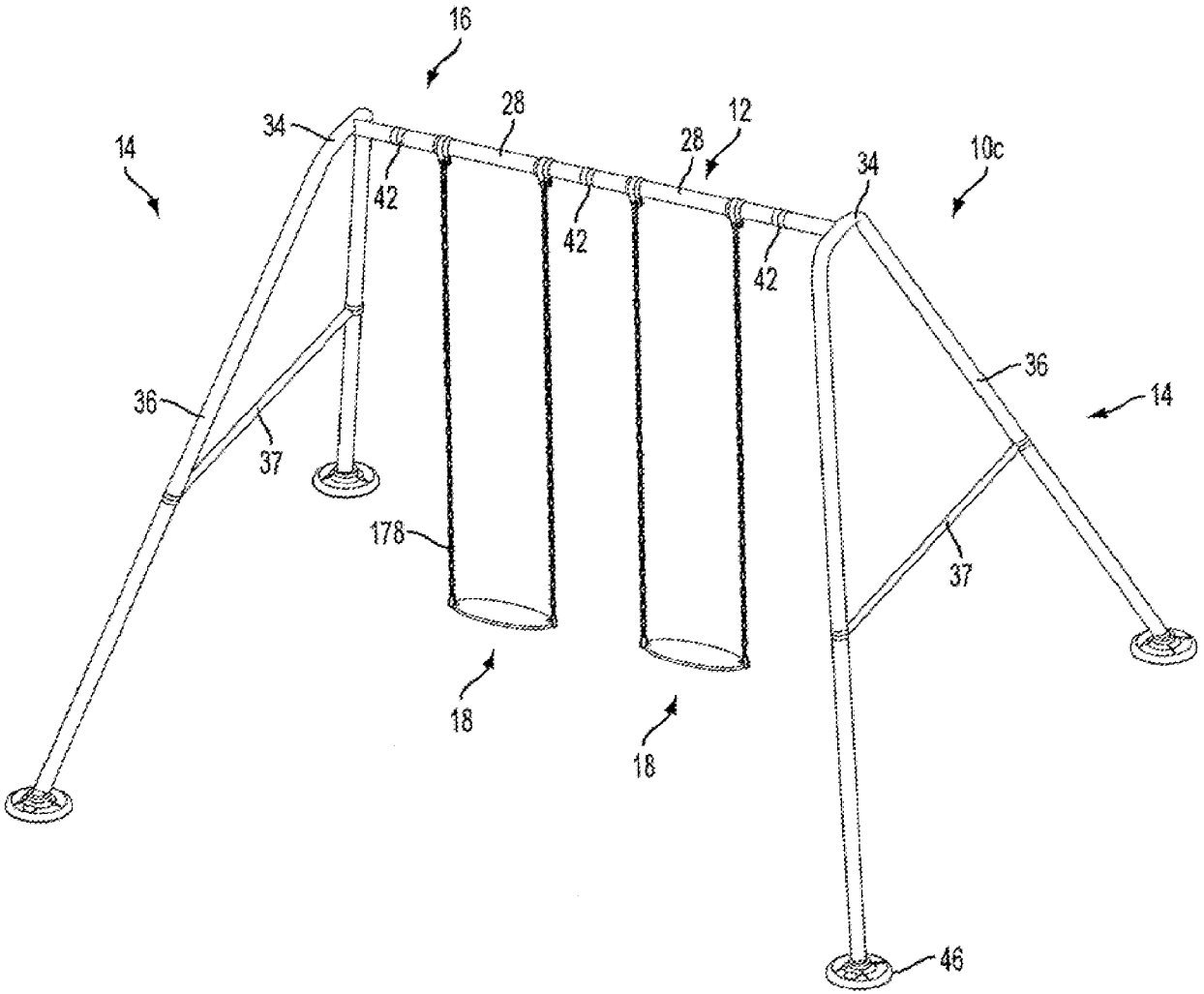
FIG. 4 is a perspective view of a third swing set of the present disclosure showing the swing set including a pair of swing seats.

To create larger or smaller swing sets 10, apparatus, middle leg units 15, and single and dual support tubes 28, 30 can be added or removed. For example, to assembly a most basic swing set 10*b*, no middle leg unit 15 is provided and only a single swing seat 18 and single pivot support tube 28 is provided as shown in FIG. 3.

Such a basic swing set 10*b* may be initially purchased by a consumer with a limited budget, whom would like to create a larger swing set 10 as additional funds become available, a consumer whom only currently needs a small swing set 10*b*, or a consumer with a limited amount a space to erect a swing set 10. For example, a consumer whom initially purchases a kit or individual components to erect swing set 10*b* of FIG. 3, may later purchase another swing seat 18 and single pivot support tube 28 and add these components to swing set 10*b* to create larger swing set 10*c* shown in FIG. 4. To erect swing set 10*c* from swing set 10*b*, single pivot support tube 28 of swing set 10*b* is first detached from connector 42 adjacent one of end leg units 14. Next, the new single pivot support tube 28 is coupled to the old single pivot support tube 28 with a new connector 42. Finally, the opposite end of the new single pivot support tube 28 is coupled to the old connector 42 that remained attached to detached end leg unit 14. The consumer may also purchase all the components of swing set 10*c* at one time rather than at separate times.

Figure 5:
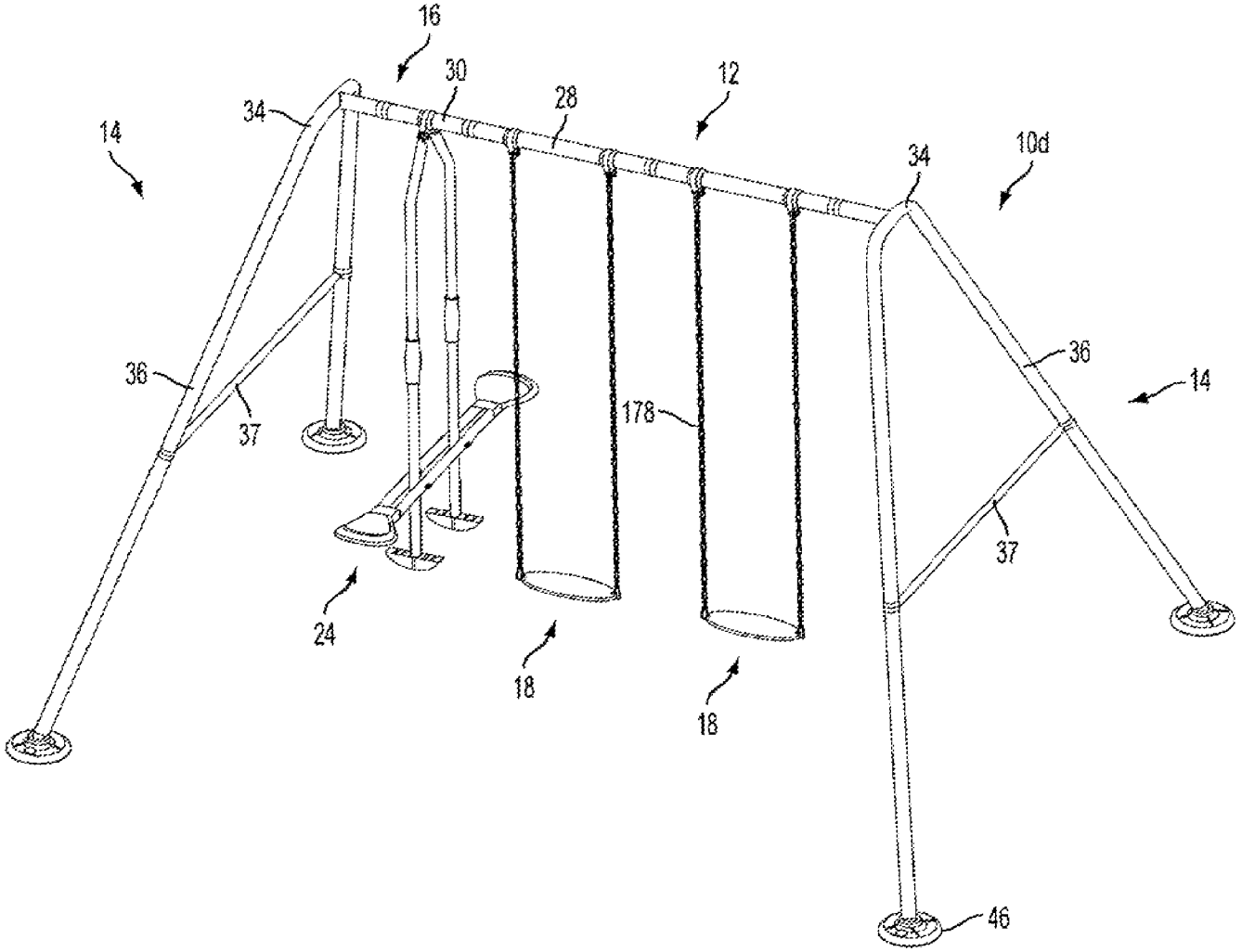
FIG. 5 is a perspective view of a fourth swing set of the present disclosure showing the swing set including a pair of swing seats and a tandem glider.
Figure 6:
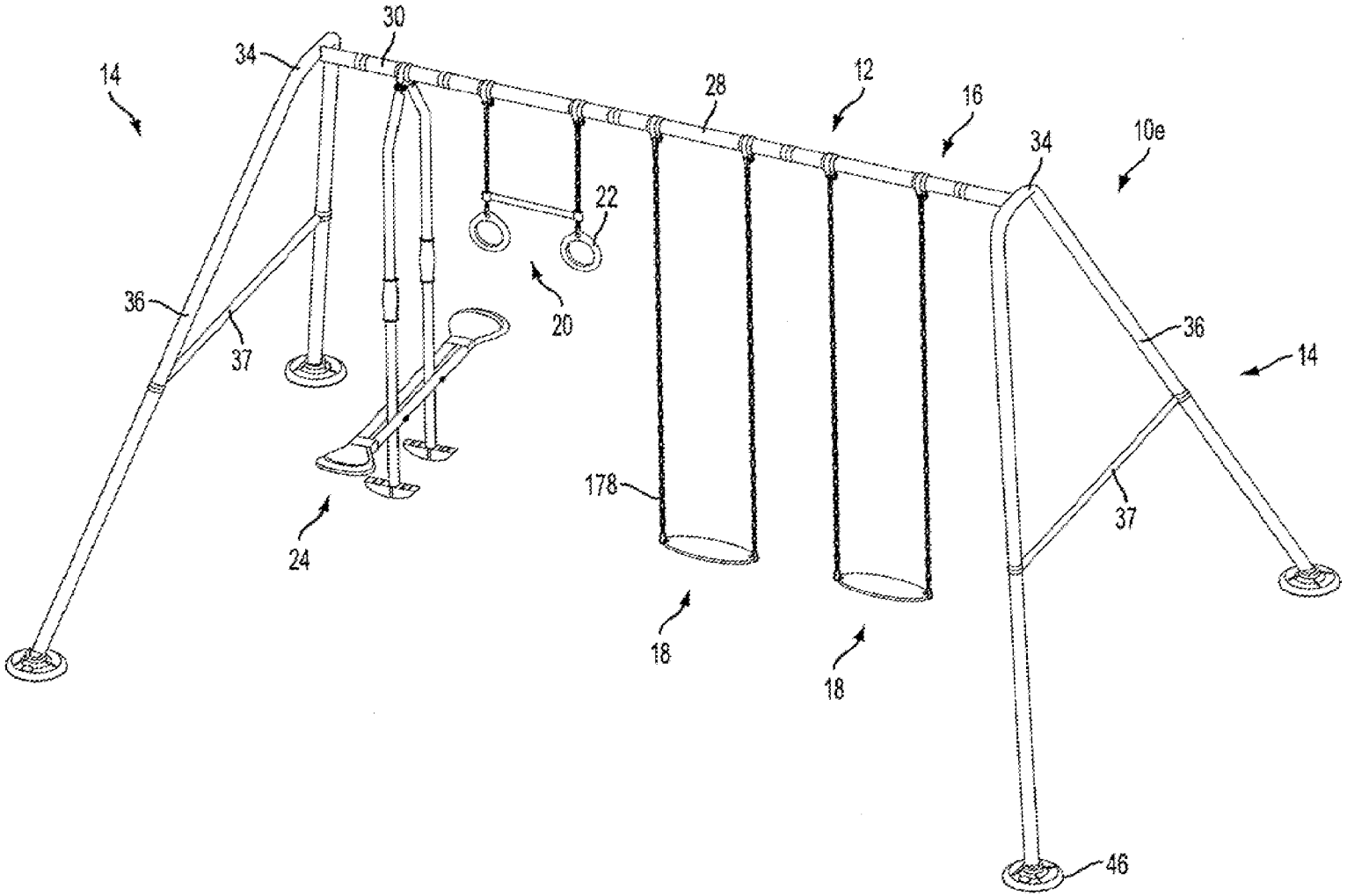
FIG. 6 is a perspective view of a fifth swing set of the present disclosure showing the swing set including a pair of swing seats, a trapeze bar with rings, and a tandem glider.
Figure 7:
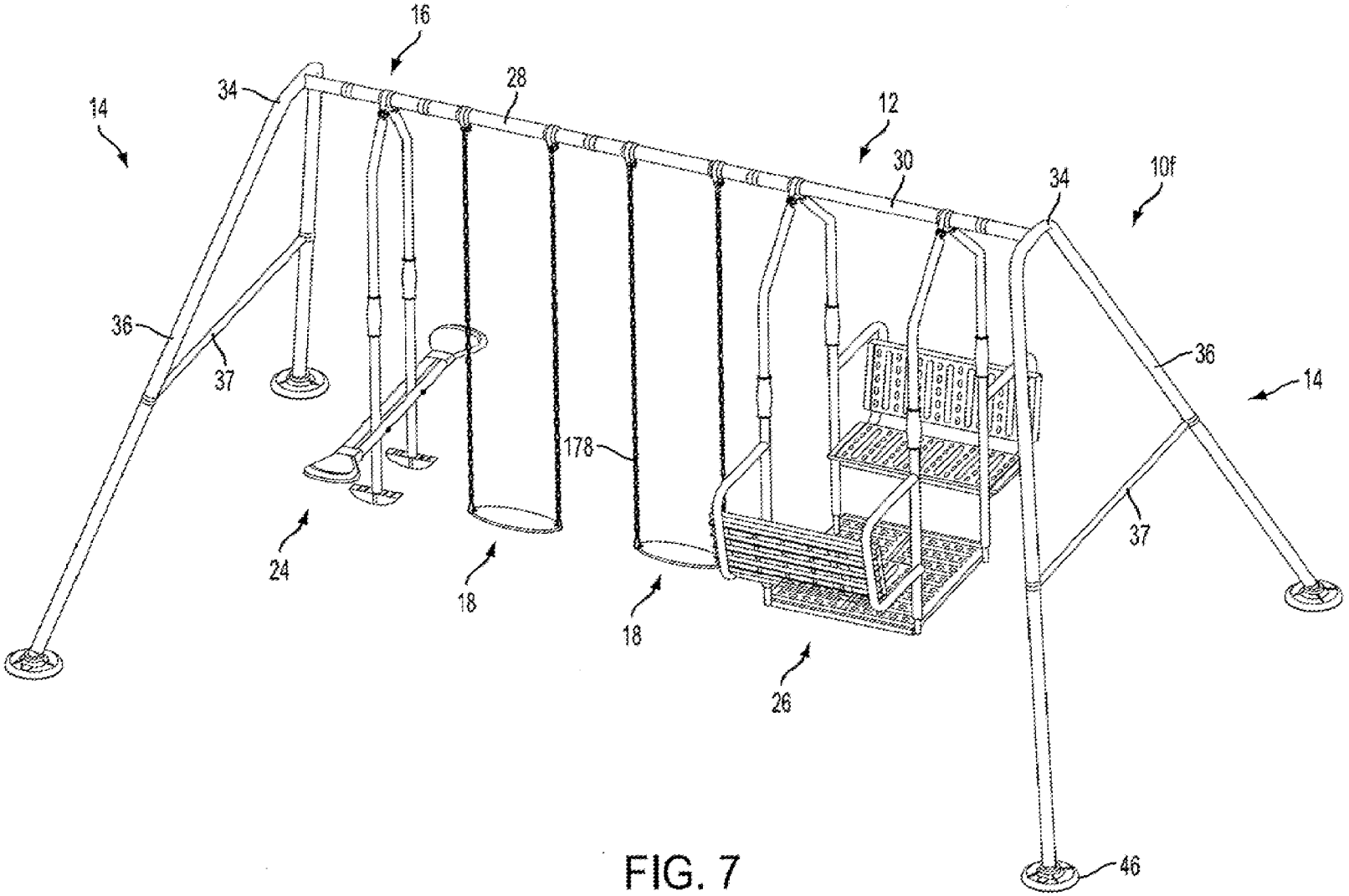
FIG. 7 is a perspective view of a sixth swing set of the present disclosure showing the swing set including a pair of swing seats, a tandem glider, and a dual bench glider.
Figure 8:
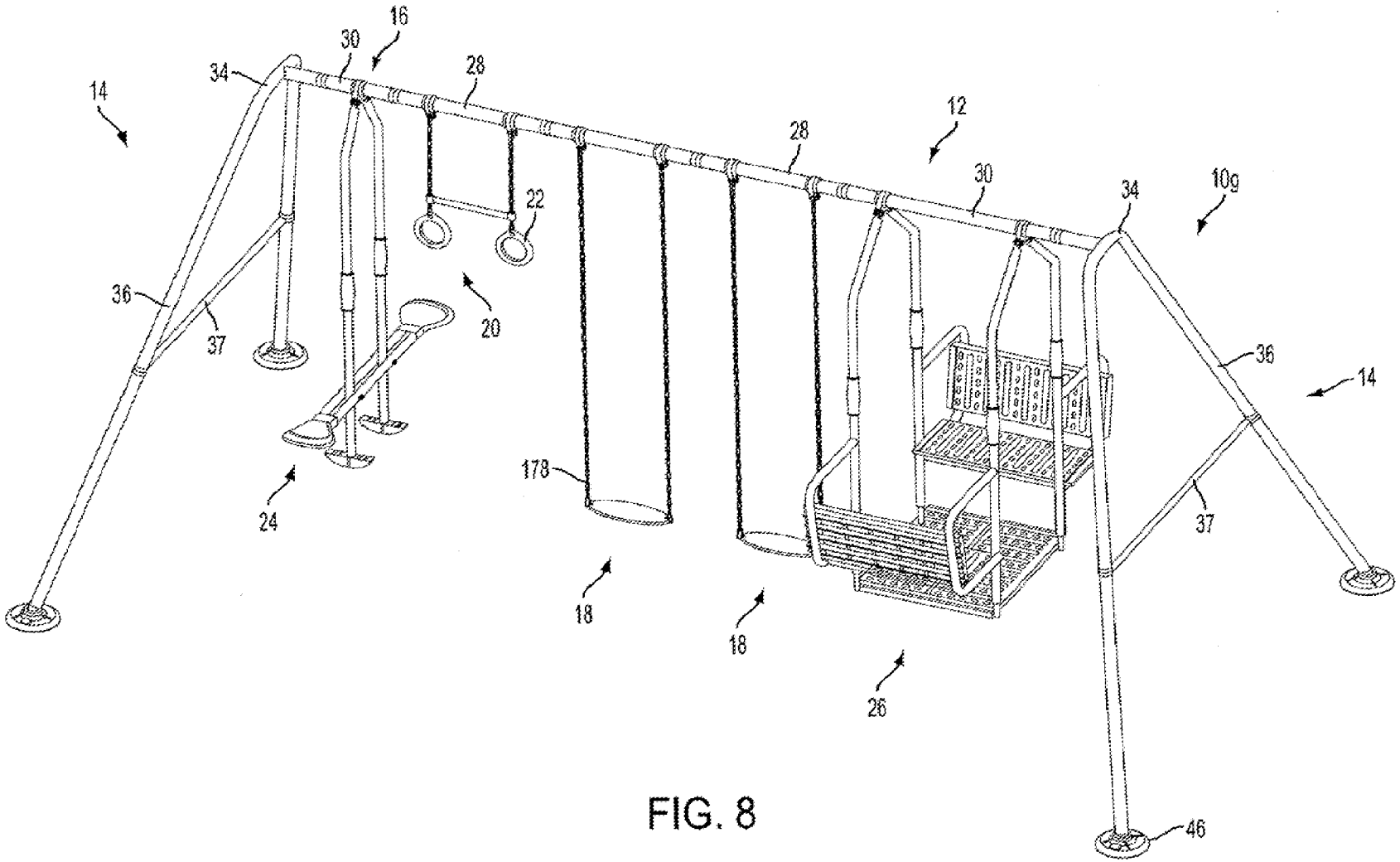
FIG. 8 is a perspective view of a seventh swing set of the present disclosure showing the swing set including a pair of swing seats, a trapeze bar with rings, a tandem glider, and a dual bench glider.
Figure 9:
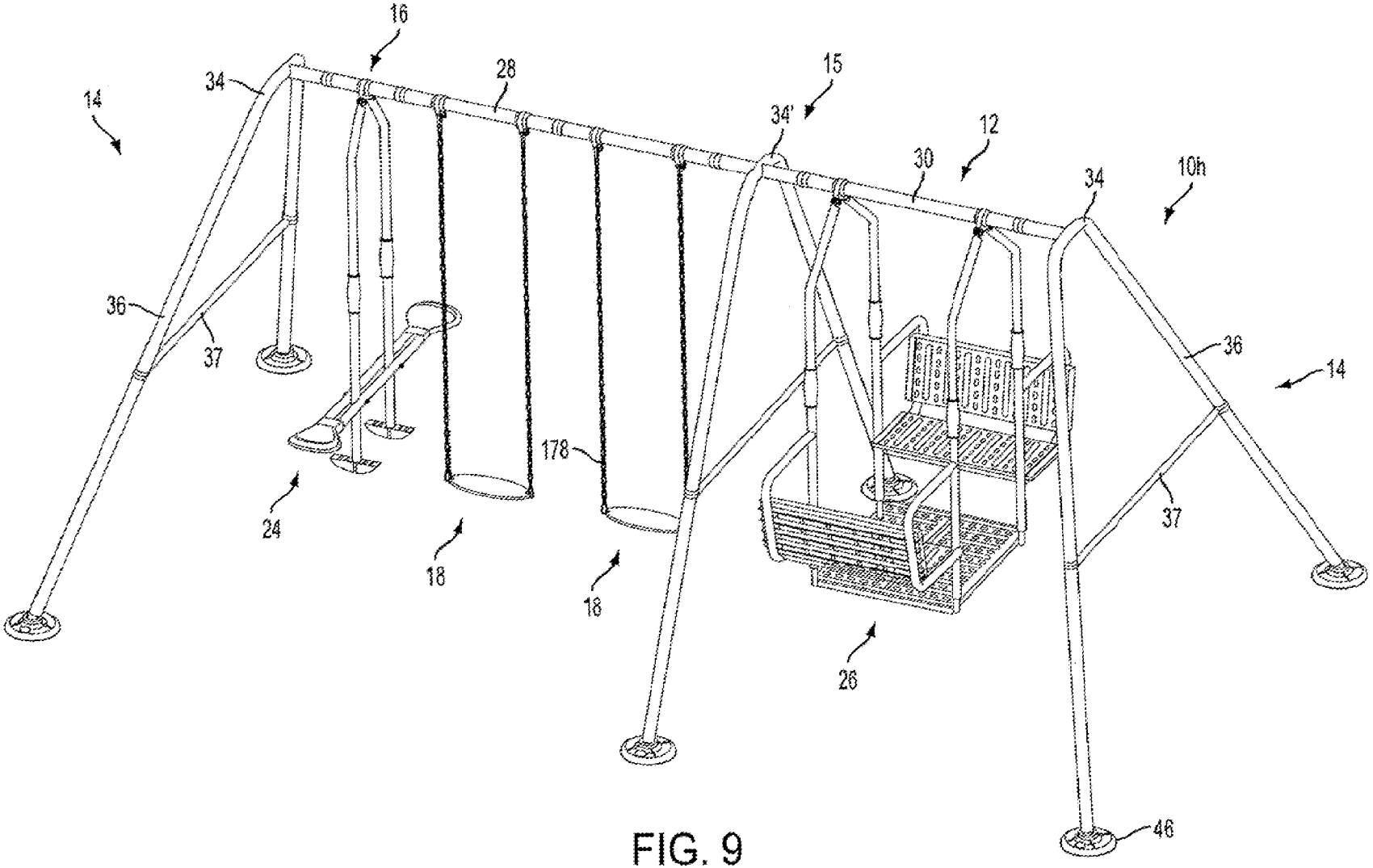
FIG. 9 is a perspective view of a eighth swing set of the present disclosure showing the swing set including a pair of swing seats, a tandem glider, a dual bench glider, and three pairs of legs.
Figure 10:
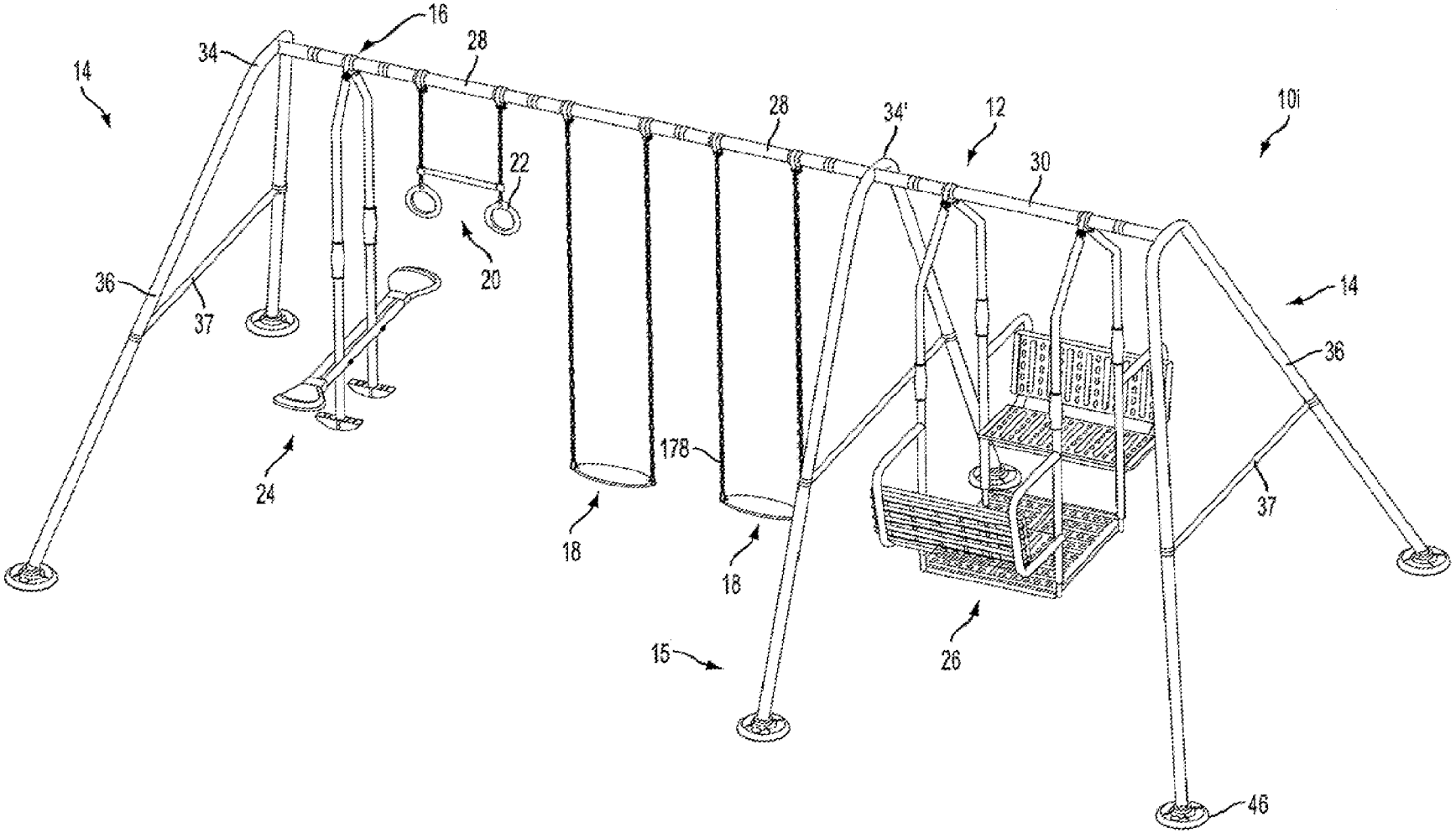
FIG. 10 is an perspective view of a ninth swing set of the present disclosure showing the swing set including a pair of swing seats, a trapeze bar with rings, a tandem glider, a dual bench glider, and three pairs of legs.
Figure 11:
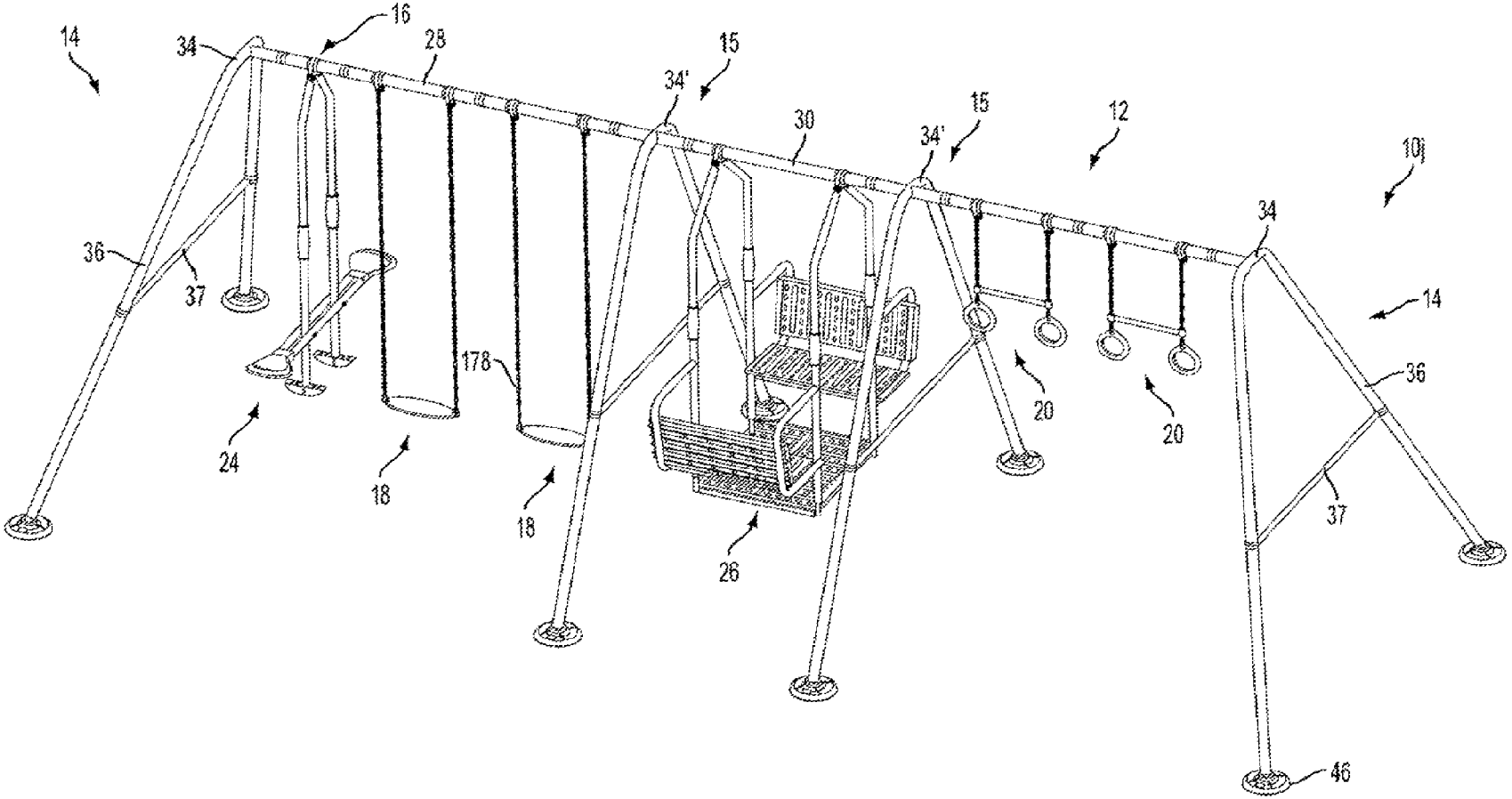
FIG. 11 is an perspective view of a tenth swing set of the present disclosure showing the swing set including a pair of swing seats, a pair of trapeze bars with rings, a tandem glider, a dual bench glider, and four pairs of legs.
Figure 12:
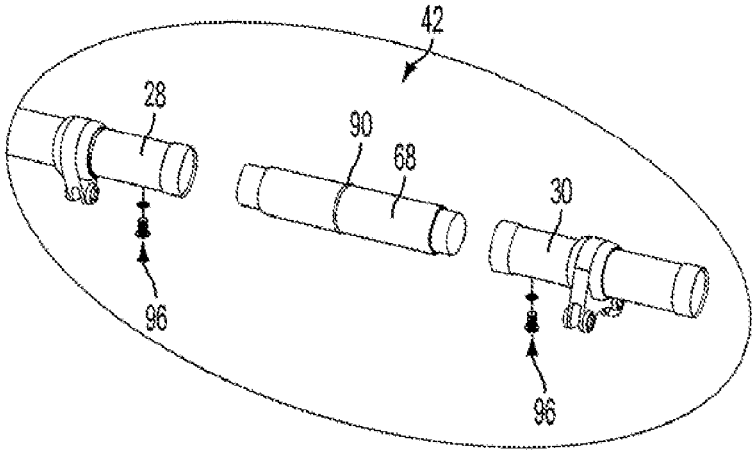
FIG. 12 is an assembly view of a pair of support tubes and a connector configured to couple the support tubes together to define a portion of the support beam.
Figure 13:
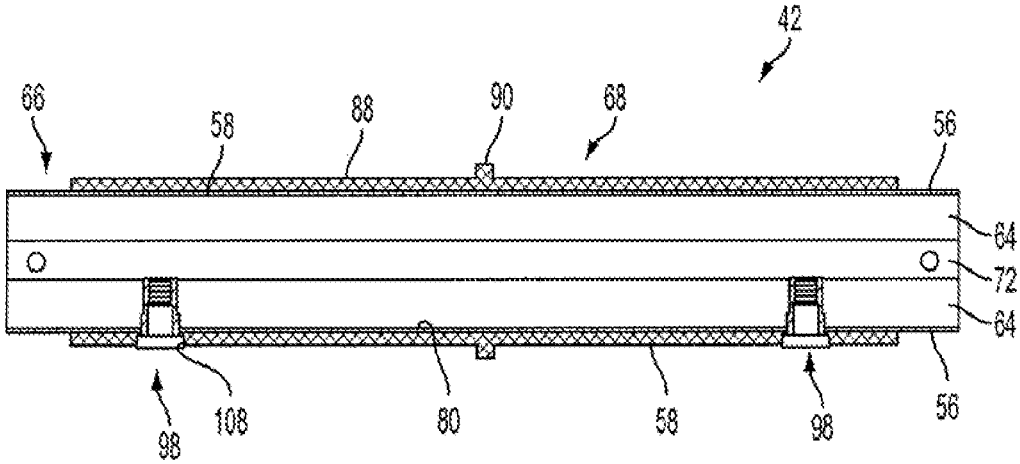
FIG. 13 is a cross-sectional view of the connector of FIG. 12.
Figure 14:
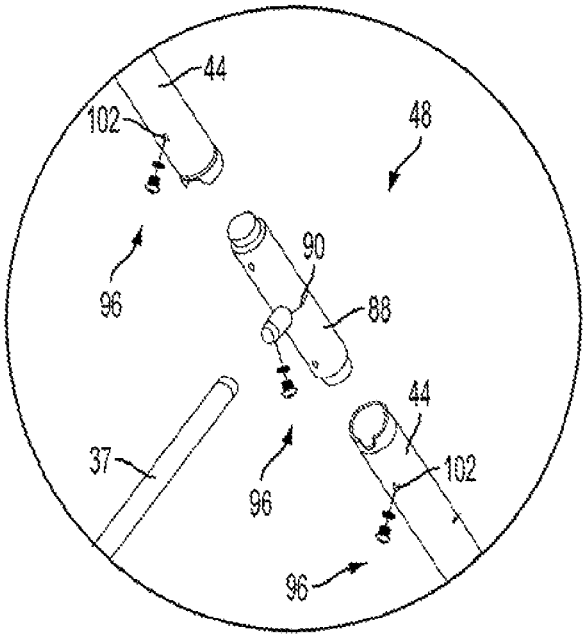
FIG. 14 is an assembly view of a pair of leg tubes, a cross member, and a connector configured to couple the leg tubes and cross member together.

A slightly larger swing set 10*d* is shown in FIG. 5. Swing set 10*d* includes all of the components of swing set 10*c* of FIG. 4 and a tandem glider 24. Similar to swing sets 10*b* and 10*c*, swing sets 10*d-j* may be constructed using components from previously erected swing sets 10, such as swing sets 10*b* or 10*c*, or may be constructed from scratch from components purchased at one time. An even larger swing set 10*e* is shown in FIG. 6. Swing set 10*e* includes all the components of swing set 10*d* of FIG. 5 and a trapeze bar 20 with rings 22. Swing set 10*f* of FIG. 7 includes all the components of swing set 10*d* with a dual bench glider 26. Swing set 10*g* of FIG. 8 includes all the components of swing set 10*f* and a trapeze bar 20 with rings 22. Swing set 10*h* of FIG. 9 includes all the components of swing set 10*f* and a middle leg unit 15 positioned between dual bench glider 26 and one of swing seats 18. Swing set 10*i* of FIG. 10 includes all the components of swing set 10*h* and a trapeze bar 20 with rings 22. Swing set 10*j* of FIG. 11 includes all the components of swing set 10*i*, another trapeze bar 20, and another middle leg unit 15. Additional swing set combinations may also be created.

A retailer may sell the components of swings sets 10 in pre-packaged groups or individually. For example, the components necessary to erect swing set 10*a* may be sold as a kit and other components, such as middle leg unit 15, swing seat 18 with a single pivot support tube 28, trapeze bar 20 with rings 22 and a single pivot support tube 28, tandem glider 24 with a dual pivot support tube 30, and dual bench glider 26 with a dual pivot support tube 30 may be sold separately. This allows a consumer to pick and choose which apparatus they want for their own customized swing set 10. This also allows the consumer to add apparatus at a future date by purchasing only the apparatus they desire to add. For example, if a consumer desires to add another swing, they may purchase swing seat 18, a single pivot support tube 28, and a connector 42 without the need to purchase an entire swing set kit that includes unneeded end leg units 14.

Figure 2:
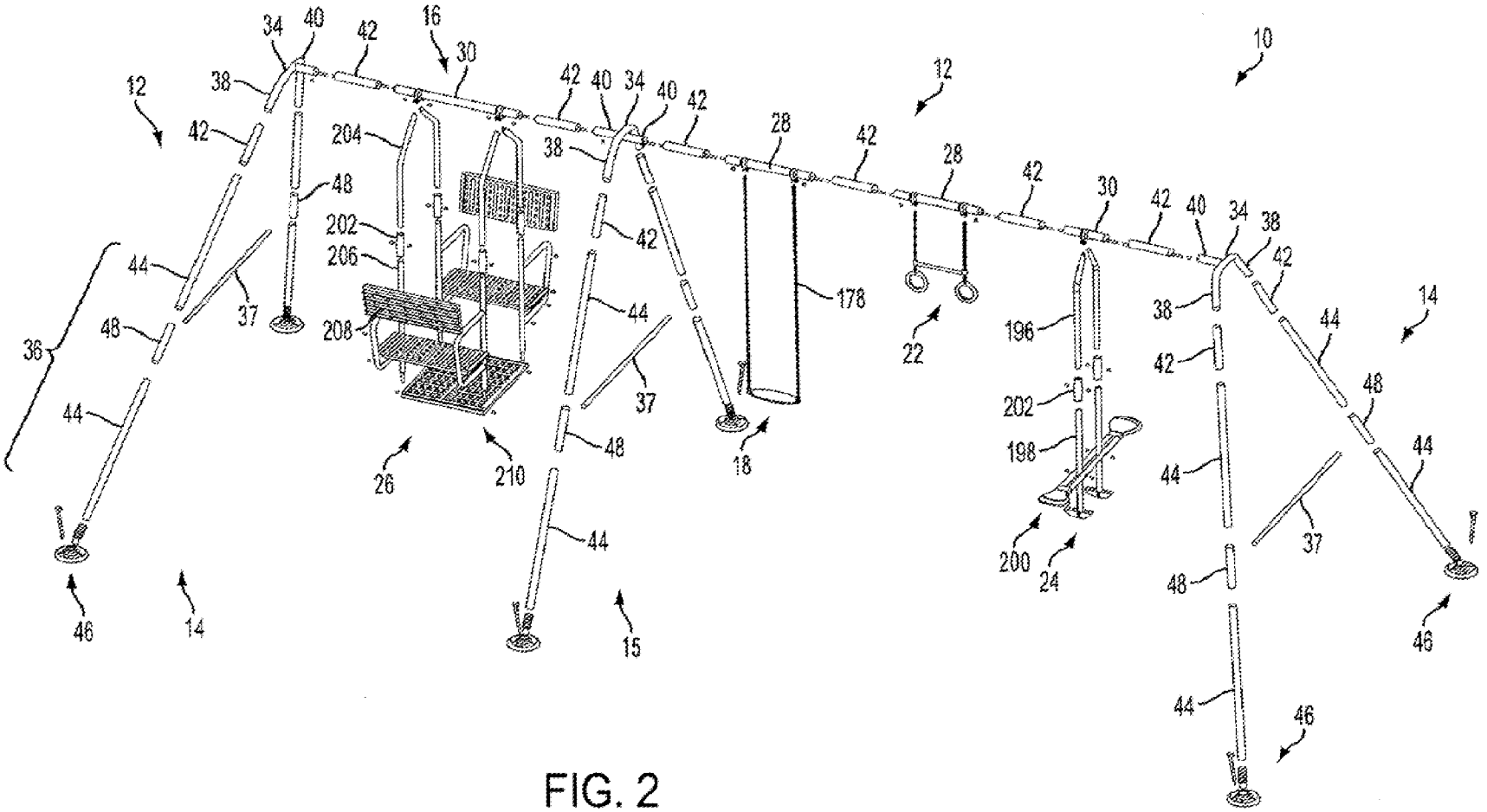
FIG. 2 is an exploded assembly view of the swing set of FIG. 1.
Figure 2A:
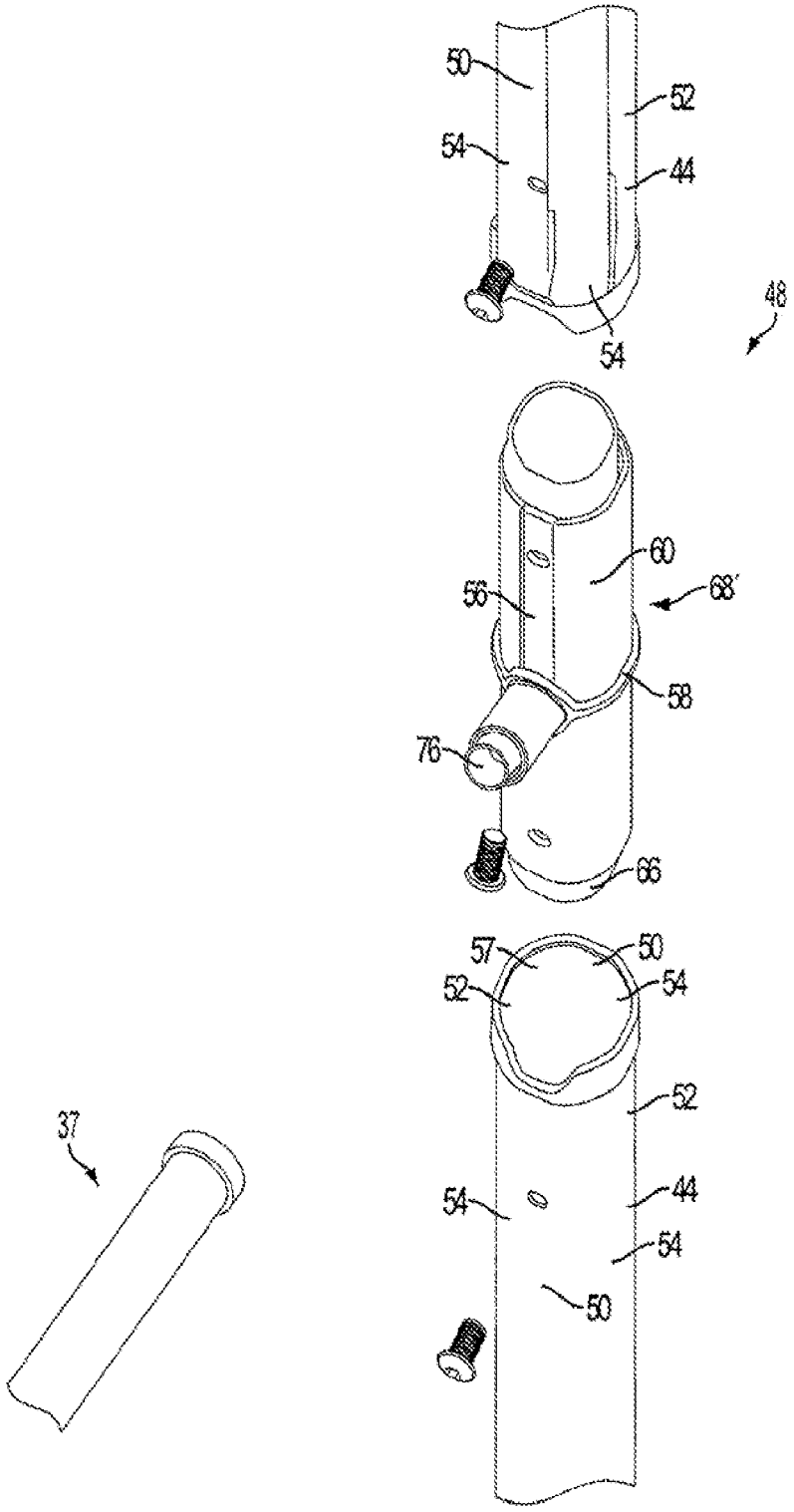
FIG. 2A is an enlarged view of leg of the swing set of FIG. 1.
Figure 2B:
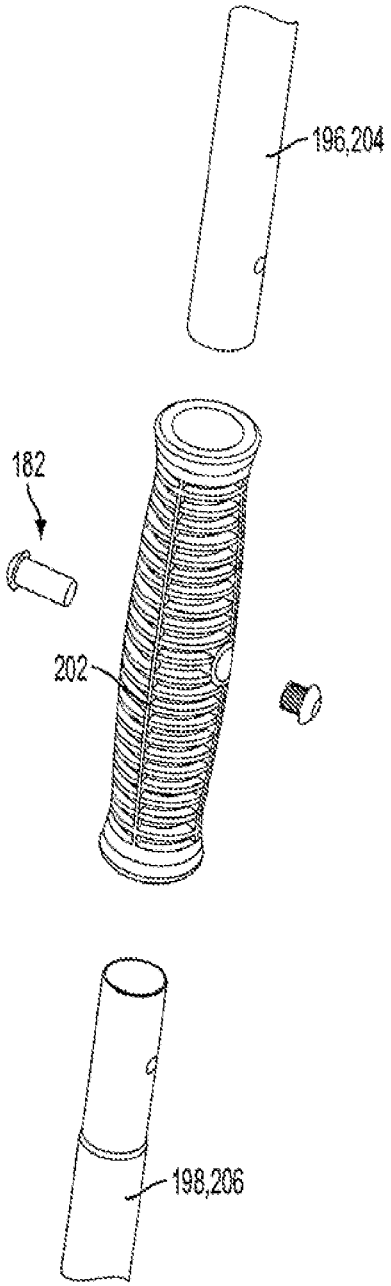
FIG. 2B is an enlarged view of a pair of support tubes of the swing set of FIG. 1 and a handle.

Additional detail of the various components of swing sets 10 is provided in FIGS. 2, 2A, 2B and 12-24. As shown in FIG. 2, each leg unit 14 includes a joint member 34, two supporting legs 36 coupled to joint member 34 and a cross tube 37 connecting supporting legs 36. Joint member 34 includes two arm tubes 38 that connect to supporting legs 36 and a beam support tube 40 that connects to beam 16. Legs 36 and arm tubes 38 lie in the same plane and form an inverted 'V' shape. Beam support tube 40 is slightly offset from being perpendicular to this plane so that legs 36 lean inward toward beam 16. As discussed in greater detail below, connectors 42 are provided between arm tubes 38 and legs 36 to provide the connection therebetween. Joint member 34' includes two arm tubes 38 that connect to supporting legs 36 and two beam support tubes 40 that connect to beam 16. Beam support tubes 40 of joint member 34' are perpendicular to the plane defined by legs 36. As discussed in greater detail below, connectors 42 are provided between arm tubes 38 and legs 36 to provide the connection therebetween.

Preferably, each leg 36 includes at least two leg tubes 44 and a pair of supporting feet 46. A connector 48 is provided between leg tubes 44 that also connect to cross tube 37. As discussed below, connectors 42, 48 fit within respective arm tubes 38 and leg tubes 44.

Figure 16:
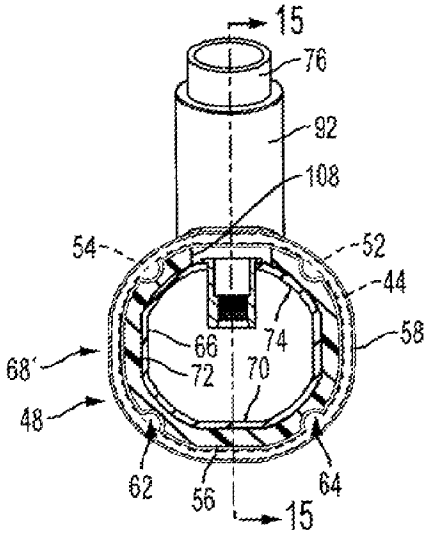
FIG. 16 is another cross-sectional view of the leg connector of FIG. 15 taken along line 14-14 of FIG. 15.
Figure 19:
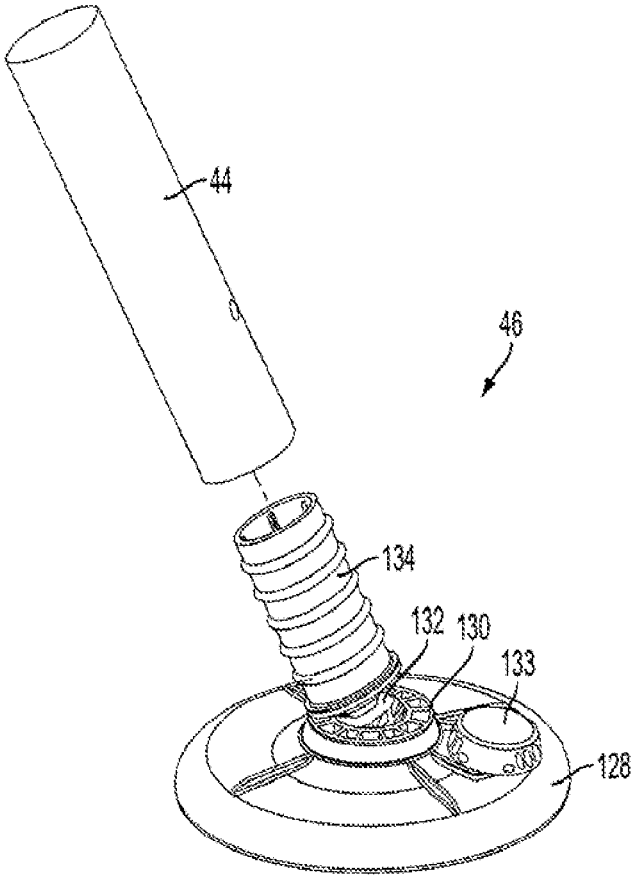
FIG. 19 is a partial exploded assembly view of a leg of the swings sets and a foot of the swing sets.
Figure 20:
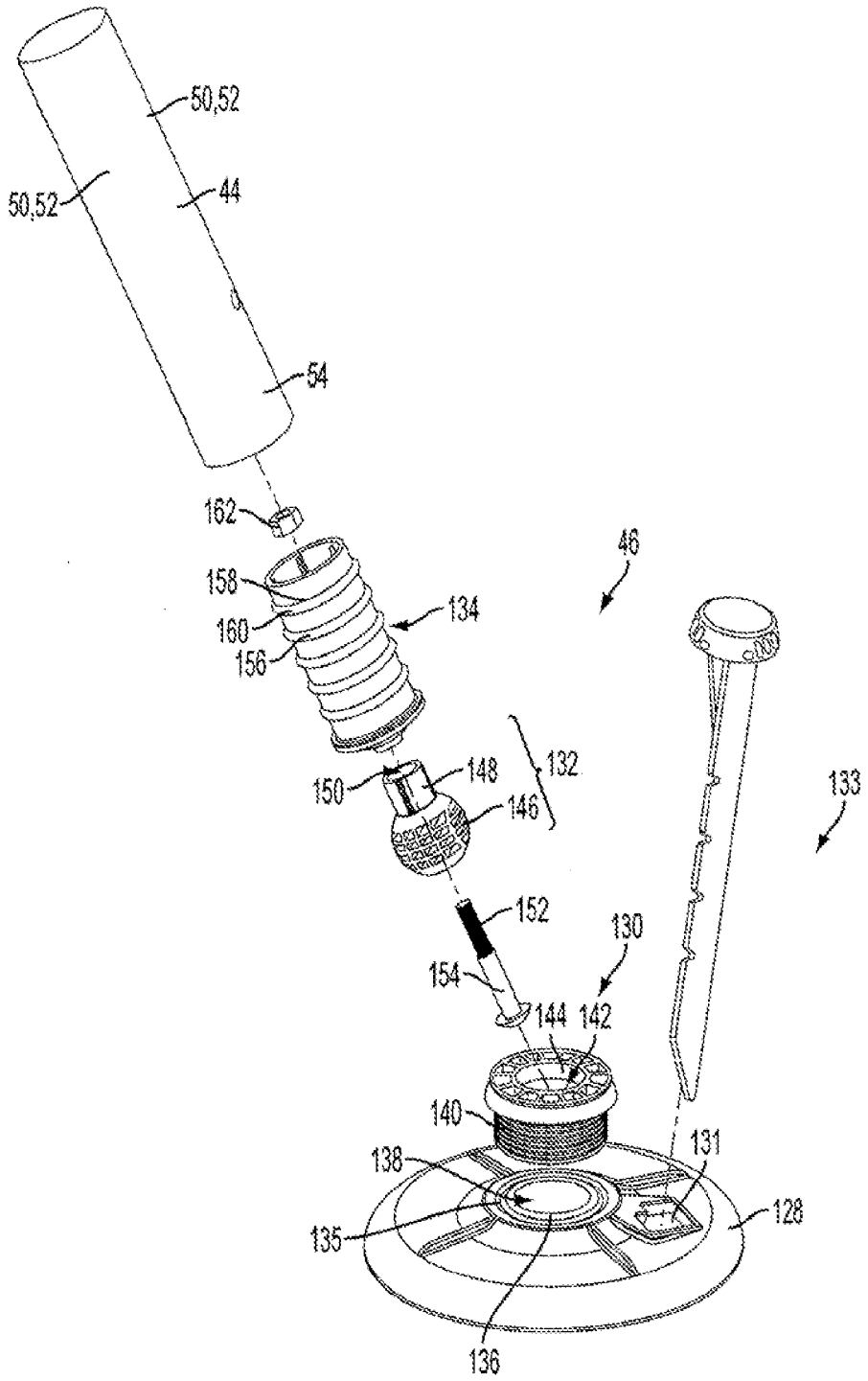
FIG. 20 is an exploded assembly view of the foot of the swing sets.

Tubes 28, 30, 38, 40, 44 are preferably octagonal, having eight sided having four straight sides and four circular sides as shown, for example, in FIGS. 16, 19, and 20 for support tubes 44. As shown in FIG. 20 for tube 44, each tube 28, 30, 38, 40, 44 has two parallel straight sides 50, two additional parallel straight sides 52 that are perpendicular to straight sides 50, and four circular sides 54 having a radius of curvature centered on the center of the respective tubes 28, 30, 38, 40, 44. According to alternative embodiments of the present disclosure, the tubes may have other shapes, such as circular, square, or other shapes known to those of ordinary skill in the art.

Figure 18:
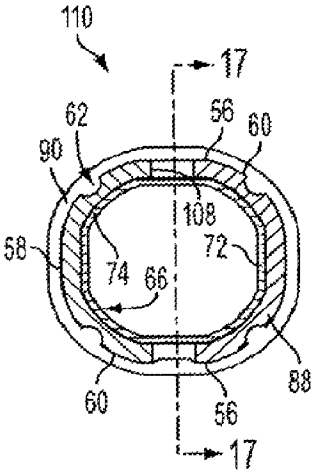
FIG. 18 is a cross-sectional view of the leg connector of FIG. 17 taken along line 18-18 of FIG. 17.

Connectors 42, 48 have an exterior profile that substantially matches the eight-sided inner profile of tubes 28, 30, 38, 40, 44. For example, as shown in FIGS. 16 and 18, connector 48 has four straight sides and four circular sides. Connector 48 has two parallel straight sides 56, two additional parallel straight sides 58 that are perpendicular to straight sides 56, and four circular sides 60 having a radius of curvature centered on the center of connector 48. Circular sides 60 are interrupted by a longitudinally extending groove 62. Connector 42 has an outer profile identical to the cross-section shown in FIG. 16.

During assembly, connectors 42 are inserted in respective beam support tubes 28, 30, arm tubes 38 of joint members 34, beam supporting tubes 40 of joint members 34, and upper ends of upper leg tubes 44. Similarly, connectors 48 are inserted in lower ends of upper leg tubes 44 and upper ends of lower leg tubes 44. As a result of this insertion, the respective straight sides 56, 58 of connectors 42, 48 are positioned adjacent to respective straight sides 50, 52 of tubes 28, 30, 38, 40, 44 and respective circular sides 60 of connectors 42, 48 are positioned adjacent to respective circular sides 54 of tubes 28, 30, 38, 40, 44 as shown, for example, in FIG. 16 for tube 44 (shown in phantom lines). Groove 62 of connectors 42, 48 and circular sides 54 cooperate to define a passage 64 as shown in FIG. 16.

Connectors 42, 48 each include an inner tube 66 and respective outer covers 68, 68' defining the outer profile of connectors 42, 48 having straight sides 56, 58 and circular sides 60. Inner tube 66 includes four straight sides, four circular sides, a longitudinal axis 57, and a length greater than a length of the outer covers 68, 68' so that portions of an exterior surface 59 of inner tube 66 are not covered by covers 68, 68'. During formation of covers 68, 68', the portions of exterior surface 59 that are not covered are gripped and covered by the injection molding machine while the remainder of exterior surface 59 is covered with the plastic that forms covers 68, 68'. Alignment apertures 69 may be provided in inner tube 66 for the injection molding machine to align inner tube 66 with the injection molding die (not shown).

Tube 66 has two parallel straight sides 70, two additional parallel straight sides 72 that are perpendicular to straight sides 70, and four circular sides 74 having a radius of curvature centered on the center of tube 66. Additionally, connector 48 includes a circular side tube 76, which is welded to its respective inner tube 66.

Figure 15:
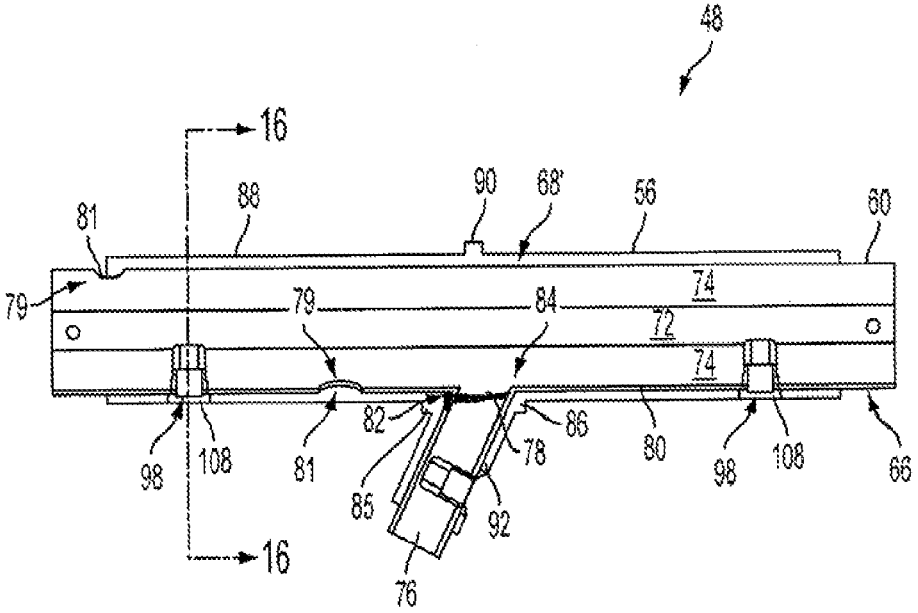
FIG. 15 is a cross-sectional view of a leg connector of the swing sets taken along line 15-15 of FIG. 16.

During manufacture, outer covers 68, 68' are overmolded onto inner tubes 66 and circular tube 76 for cover 68'. Preferably, outer covers 68, 68' are made of a rigid, plastic material and tubes 28, 30, 38, 40, 44, 66, 76 are made of metal, such as steel. Outer covers 68, 68' are integral/one piece having continuous portions that encircle radial portions of tubes 66, 76. Although they may be provided, no fasteners, adhesives, etc. are required to hold covers 68, 68' on tubes 66, 76. Each inner tube 66 and side tube 76 is unique, having different surface features resulting from their manufacture. For example, as shown in FIG. 15, inner tube 66 has random, unique dimples 79 (or bumps) (shown larger than normal for illustrative purposes). Cover 68 is formed to include bumps 81 (or dimples) that matches and substantially fills dimple 79. Similarly, weld 78 between inner tube 66 and side tube 76 is unique for each connector 48. An inner surface 80 of outer cover 68, 68' is customized to match the unique features of each inner tube 66, side tube 76, and weld 78. For example, weld 78 shown in FIG. 15, may have a first portion 82 that is thicker than a second portion 84. Inner surface 80 of cover 68' is formed to provide a customized match for first and second portions 82, 84 of weld 78 so that first portion 85 of cover 68' is thinner and second portion 86 of cover 68' is thicker. By customizing inner surfaces 80 of covers 68, 68' to match exterior surfaces of inner tube 66, side tube 76, and weld 78, covers 68, 68' provide a substantially weather-tight seal to reduce corrosion. For example, by bump 81 filling dimple 79, water is less likely to penetrate inside of covers 68, 68' and corrode inner tube 66, side tube 76, or weld 78.

Each cover 68, 68' includes a main body portion 88 and a collar 90 that is positioned between respective tubes 28, 30, 38, 40, 44 after assembly. Cover 68' of connector 48 further includes a side body portion 92 covering side tube 76 and a collar 94 at the base of side body portion 92.

When fully assembled, portions of covers 68, 68' will be positioned directly between two metal tubes. For example, main body portions 88 are positioned between respective support tubes 28, 30, 38, 40, 44 and inner tubes 66. Similarly, side body portion 92 is positioned between cross tube 37 and side tube 76. Likewise collar 90 is positioned between respective ends of adjacent tubes 28, 30, 38, 40, 44.

Connectors 42, 48 are secured to tubes 28, 30, 38, 40, 44 with fasteners, such as bolts 96. According to one embodiment, connectors 42, 48 include threaded inserts 98 that are welded to inner tubes 66. Threaded shanks of bolts extend through holes 102 in tubes 28, 30, 38, 40, 44 and into threaded bores of inserts 98. The heads of bolts 96 remain outside of tubes 28, 30, 38, 40, 44 to secure tubes 28, 30, 38, 40, 44 to inner tubes 66 of connectors 42, 48. Covers 68, 68' of connectors 42, 48 each include apertures 108 through which the threaded shanks of bolts 96 extend to reach threaded inserts 98.

Figure 17:
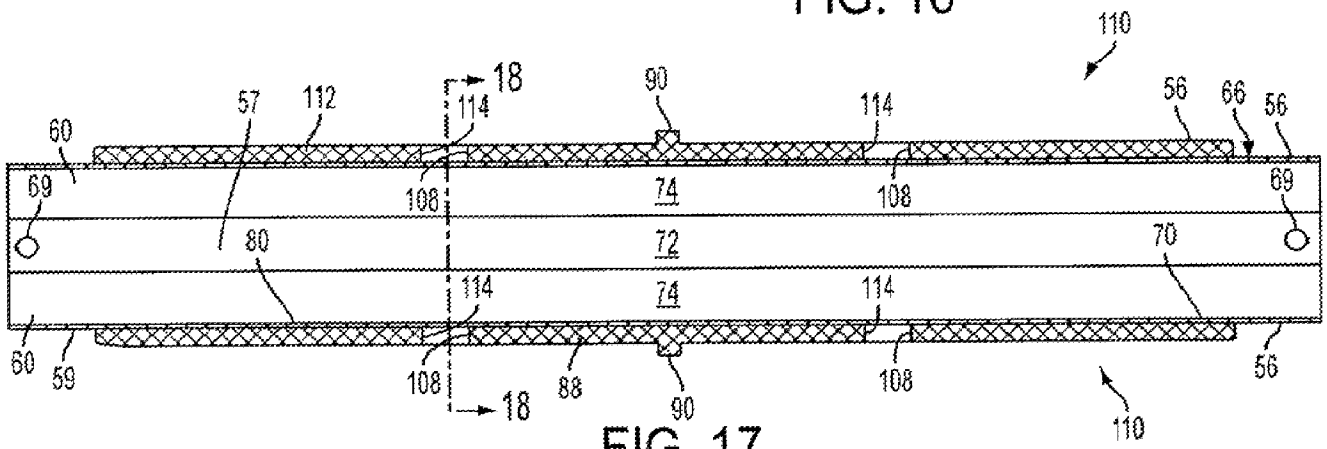
FIG. 17 is a cross-sectional view of an alternative embodiment leg connector taken along line 17-17 of FIG. 18.

According to an alternative embodiment of the present disclosure shown in FIGS. 17 and 18, an alternative embodiment connector 110, which is similar to connector 42, does not include threaded inserts 98. Rather, connector 110 includes additional apertures 108 in cover 112 and inner tube 66 includes apertures 114 aligned with apertures 108 and apertures 116 in tubes 28, 30, 38, 40, 44. Bolts 96 extends through apertures 108, 114, 116 with the head positioned on one side of tubes 28, 30, 38, 40, 44 and a portion of the threaded shank positioned on the other side of tubes 28, 30, 38, 40, 44. A nut is coupled to the shank to couple connector 110 to tubes 28, 30, 38, 40, 44. Similar apertures 108, 114 may be provided on a connector (not shown) similar to connector 48.

As shown in FIGS. 19 and 20, swing sets 10 include feet 46 positioned at the lower ends of legs 36. Feet 46 include a base 128, socket 130, ball 132, and stem 134. The connection between ball 132 and socket 130 permits base 128 to pivot relative to tubes 44 so that base 128 may lie flat on the ground surface even if the ground is not exactly horizontal.

Base 128 includes an aperture 131 sized to receive a stake 133 therethrough to secure swing sets 10 to the ground. Base 128 includes a threaded interior surface 135 and a boss 136 having an interior region 138. Socket 130 includes a threaded exterior surface 140 that mates with threaded interior surface 135 of base 128, an interior region 142 sized to receive boss 136, and a rim 144.

Ball 132 includes a spherical portion 146 and a neck 148. Spherical portion 146 and neck 148 having a through bore 150 sized to receive a shank 152 of bolt 154. Stem 134 includes a plurality of annular ribs 156 having circular portions 158 and flat portions 160.

During assembly, neck 148 of ball 132 is inserted through rim 144 of socket 130 so that spherical portion 146 is positioned within interior region 142. Bolt 154 extends through bore 150 and into stem 134. Bolt 154 is coupled to stem 134 with nut 162. Socket 130 is coupled to base 128 by threading exterior surface 140 into threaded interior surface 135 of base 128. During this coupling, boss 136 of base 128 is positioned within interior region 142 and spherical portion 146 of ball 132 is positioned within interior region 138 of boss 136. Stem 134 is inserted into lower ends of legs 36 with circular portions 158 aligned with circular sides 54 of tube 44 and flat portions 160 aligned with straight sides 50, 52 tubes 44.

Figure 21:
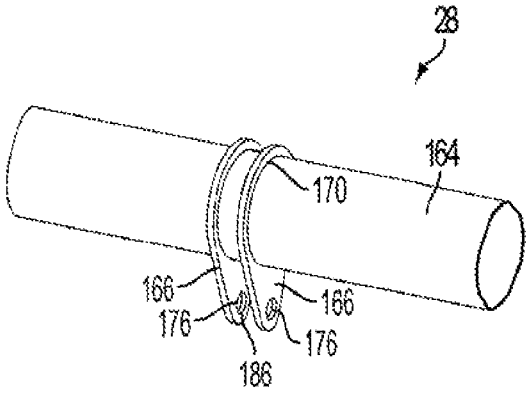
FIG. 21 is a perspective view of a swing support member showing the member including a tube and a pair of single pivot flanges welded to the tube.
Figure 23:
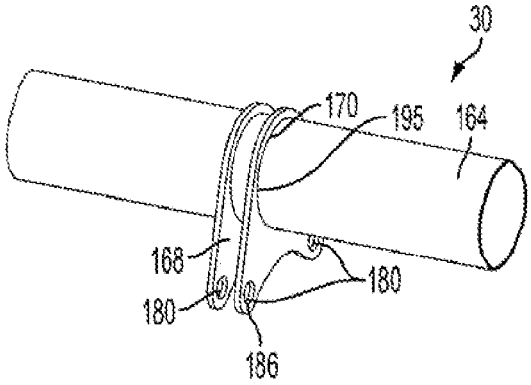
FIG. 23 is a perspective view of another swing support member showing the member including a tube and a pair of dual pivot flanges welded to the tube.

As shown in FIGS. 21 and 23, single pivot support tube 28 and dual pivot support tube 30 each include a tube section 164 having straight sides 50, 52 and circular sides 54 discussed above. Single pivot support tube 28 includes a pair of single pivot flanges 166 and dual pivot support tube 30 includes a pair of dual pivot flanges 168. Flanges 166, 168 each include a tube-receiving aperture 170 defined by four straight edges 172 and four circular edges 174 matching straight sides 50, 52 and circular sides 54 of tube sections 164. Flanges 166, 168 are preferably welded to tube sections 164. As shown in FIGS. 21 and 23, flanges 166 include a single aperture 176 to receive bolt 182 supporting chain link 178 and flanges 168 include a pair of apertures 180 to receive bolts 182 and support a tube of either tandem glider 24 or dual bench glider 26.

Figure 22:
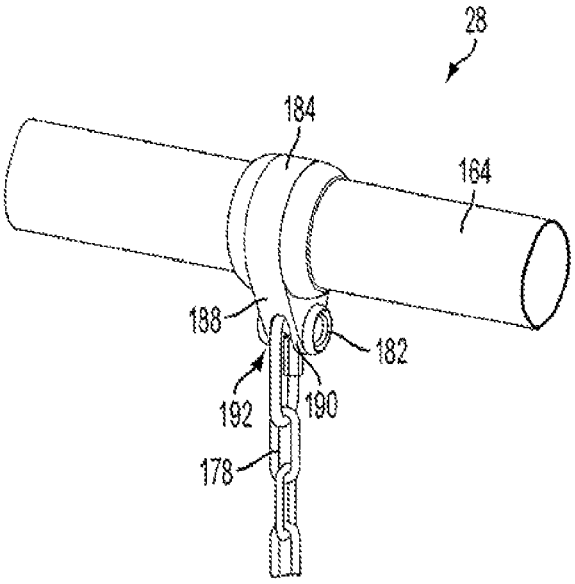
FIG. 22 is a perspective view of the swing support member of FIG. 21 showing the pair of single pivot flanges overmolded with plastic and a chain hanging from a bolt extending between the pair of single pivot flanges to support a swing set apparatus, such as a portion of a swing seat or a trapeze bar.
Figure 24:
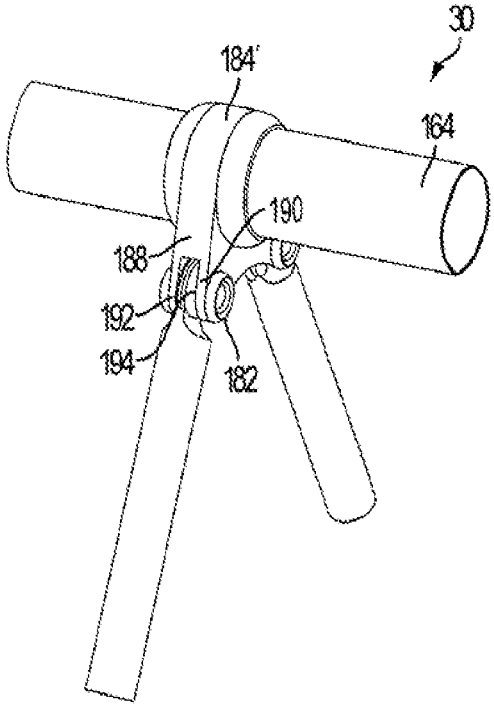
FIG. 24 is a perspective view of the swing support member of FIG. 23 showing the pair of single pivot flanges overmolded with plastic and another swing set apparatus, such as a dual bench glider, bolted to the flanges.

Single and dual pivot support tubes 28, 30 further includes outer covers 184, 184' that encase respective single pivot flanges 166 and dual pivot flanges 168. During manufacture, outer covers 184, 184' are overmolded onto tube section 164 and flanges 166, 168 as shown in FIGS. 22 and 24. Preferably, outer covers 184, 184' are made of a rigid, plastic material and tube sections 164 and flanges 166, 168 are made of metal, such as steel. Covers 184, 184' are integral/one piece having continuous portions that encircle radial portions of tube sections 164. Furthermore, all but inner edges 186 of flanges 166, 168 that define apertures 176, 180 are covered by the plastic of covers 184, 184'. Thus, portions of covers 184, 184' are positioned directly between flanges 166, 168. For example, first portion 188 extends completely between respective flanges 166, 168. Second portions 190 do not extend completely between respective flanges 166, 168, but cooperate to define a groove 192 to receive a chain link 178 or upper flange 194 of the glider tube.

Although they may be provided, no fasteners, adhesives, etc. are required to hold covers 184, 184' on tube sections 164 and flanges 166, 168. Each tube section 164 and flange 166, 168 is unique, having different surface features resulting from their manufacture. Similarly, weld 195 between tube section 164 and respective flange 166, 168 is unique for each respective support tube 28, 30. An inner surface of cover 184, 184' is customized to match the unique features of each tube section 164, flange 166, 168, and weld 195 as similarly discussed above for weld 78 of FIG. 15 Thus, the inner surfaces of covers 184, 184' (similar to covers 68, 68') are formed to provide a customized match for weld 195, tube section 164, and flanges 166, 168 for each support tube 28, 30. By customizing the inner surfaces of covers 184, 184' to match exterior surfaces of tube sections 164, flanges 166, 168, and the welds therebetween, covers 184, 184' provide a substantially weather-tight seal to reduce corrosion.

Preferably, swing sets 10 are design so that no unassembled component is longer than 47 inches long. As discussed above, legs 36 and support beam 16 are assembled from multiple components, none of which are longer than 47 inches. Similarly, tandem glider 24 and dual bench glider 26 are assembled from components that are no longer than 47 inches when in their unassembled state. Tandem glider 24 includes co-linear support tubes 196, 198 and seat beam 200 pivotably coupled to support tubes 198. Support tubes 198 are telescopically received in support tubes 196 and coupled together with bolts 182. A cylindrical handle 202 is positioned over the joint between support tubes 196, 198. Dual bench glider 26 includes support tubes 204, 206, seat panels 208, and floor beam 210 pivotably coupled to support tubes 206. Support tubes 206 are telescopically received in support tubes 204 and coupled together with bolts 182. A cylindrical handle 202 is positioned over the joint between co-linear tubes 204, 206. As a reference, tube section 164 of support tube 28 for swing seat 18 is about 36 inches long.

As shown in FIG. 1, seat 18, tandem glider 24, and dual bench glider 26 extend down from beam 16. The lower most portions of these apparatus (ex. seat 18 supported by chain 178, foot rests 211 of tandem glider 24, and platform 210 of dual bench glider 26) are spaced apart by a vertical distance from beam 16 (ex. distance L for seat 18). Distance L is greater than the length of any individual tube of the swing sets, such as tubes 28, 30, 37, 38, 40, 44, 196, 198, 204, 206. According to alternative embodiments the support beam, legs, or other components may be constructed of a single component. For example, the support beam may be constructed of a single tube without the need for connectors.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A swing set including a support beam, at least one swing apparatus configured to support a child thereon for recreation, the swing apparatus being supported by the support beam to permit swinging movement, and a plurality of legs supporting the support beam, at least one of the support beam and the plurality of legs including a metallic tube having a first end and an opposite second end, at least one metallic extension coupled to the metallic tube between the first and second ends, and a rigid, plastic cover, positioned over the metallic tube and the extension, wherein the plurality of legs includes at least two support tubes and the metallic tube and the rigid, plastic cover cooperate to define a connector coupling the two support tubes together.

2. The swing set of claim 1, wherein the metallic tube has a unique exterior surface and the rigid, plastic cover has an interior surface customized to match the unique exterior surface of the metallic tube.

3. The swing set of claim 2, wherein in the connector further includes a weld coupled to the metallic tube and the interior surface of the rigid, plastic cover is customized to match an exterior surface of the weld.

4. The swing set of claim 2, wherein in the connector further includes a dimple and the interior surface of the rigid, plastic cover is customized to provide a bump substantially filing the dimple.

5. The swing set of claim 2, wherein the rigid, plastic cover defines a continuous ring around a perimeter profile of the metallic tube.

6. The swing set of claim 2, wherein the metallic tube includes a longitudinal axis and the rigid, plastic cover includes a first end and a second end longitudinally spaced apart from the first end, the plastic cover includes a continuous strip of material extending from the first end to the second end.

7. The swing set of claim 1, wherein the connector couples the two support tubes together along a common axis, the connector extending along the common axis and having a first portion positioned within a first of the two support tubes and a second portion positioned within a second of the support tubes.

8. The swing set of claim 7, wherein the metallic tube is a metallic inner tube and the plastic cover is positioned over the metallic inner tube.

9. The swing set of claim 8, wherein the metallic inner tube has a length and the plastic cover has a length less than the length of the metallic inner tube.

10. The swing set of claim 8, wherein the connector includes at least two metallic tubes coupled together and a rigid, plastic cover positioned over the metallic tubes.

11. The swing set of claim 7, wherein said at least one of said support beam and said plurality of legs including at two support tubes includes at least three tubes, the connector having a third portion positioned in a third of the three tubes to couple the three tubes together.

12. The swing set of claim 7, wherein the connector includes a collar positioned between the two support tubes.

13. A swing set including a support beam, at least one swing apparatus configured to support a child thereon for recreation, the swing apparatus being supported by the support beam to permit swinging movement, and a plurality of legs supporting the support beam, at least one of the support beam and the plurality of legs including a metallic tube having a first end and an opposite second end, at least one metallic extension coupled to the metallic tube between the first and second ends, and a rigid, plastic cover, positioned over the metallic tube and the extension, wherein the extension supports the at least one apparatus and is a vertically extending flange.

14. The swing set of claim 13, wherein the extension is a horizontally extending tube.

15. A swing set including a support beam, at least one swing apparatus configured to support a child thereon for recreation, the swing apparatus being supported by the support beam to permit swinging movement, and a plurality of legs supporting the support beam, at least one of the support beam and the plurality of legs including a metallic tube having a first end and an opposite second end, at least one metallic extension coupled to the metallic tube between the first and second ends, and a rigid, plastic cover, positioned over the metallic tube and the extension, wherein the support beam includes at least two support tubes having an exterior profile and the rigid, plastic cover has an exterior profile larger than the exterior profile of the support tubes.

16. A swing set including a support beam, at least one swing apparatus configured to support a child thereon for recreation, the swing apparatus being supported by the support beam to permit swinging movement, and a plurality of legs supporting the support beam, at least one of the support beam and the plurality of legs including a metallic tube having a first end and an opposite second end, at least one metallic extension coupled to the metallic tube between the first and second ends, and a rigid, plastic cover, positioned over the metallic tube and the extension, wherein at least one of the support beam and the plurality of legs includes at least two support tubes having an exterior profile and the rigid, plastic cover has an exterior profile smaller than the exterior profile of the support tubes.

17. A swing set including a support beam, at least one swing apparatus configured to support a child thereon for recreation, the swing apparatus being supported by the support beam to permit swinging movement, and a plurality of legs supporting the support beam, at least one of the support beam and the plurality of legs including at least two support tubes and a connector coupling the two support tubes together, the connector including an inner tube and a plastic cover positioned between at least a first of the support tubes and the inner tube.

18. The swing set of claim 17, wherein the plastic cover is positioned between at least a second of the support tubes and the inner tube.

19. The swing set of claim 17, wherein the two support tubes have an outer profile and the inner tube has a profile having substantially the same shape as the outer profile of the two support tubes.

20. The swing set of claim 17, wherein the plastic cover includes a collar positioned between the two support tubes.

21. The swing set of claim 17, wherein the connector further includes an extension tube coupled to the inner tube and positioned between the two support tubes.

* * * * *